US005131490A

United States Patent [19]

Bell

[11] Patent Number: 5,131,490

[45] Date of Patent: Jul. 21, 1992

[54] HARNESS AND SEAT BOARD REPELLING SYSTEM

[76] Inventor: Michael Bell, 1705 Triumphe Way, Warrington, Pa. 18976

[21] Appl. No.: 569,054

[22] Filed: Aug. 17, 1990

[51] Int. Cl.[5] ..... A62B 1/06; A62B 35/00

[52] U.S. Cl. ..... 182/7; 182/3

[58] Field of Search ..... 182/5-7, 182/10, 133-134, 135, 191, 193, 3

[56] References Cited

U.S. PATENT DOCUMENTS

| | | | |
|---|---|---|---|
| 2,070,580 | 2/1937 | Cochran | 182/7 |
| 2,254,179 | 8/1941 | Hoyt | 182/7 |
| 2,667,917 | 2/1954 | Dustin | 182/7 X |
| 3,415,340 | 12/1968 | Kinkade | 182/7 |
| 3,448,826 | 6/1969 | Rosenblum | 182/3 |
| 4,378,921 | 4/1983 | Allen et al. | 182/6 X |
| 5,067,585 | 11/1991 | Bell | 182/7 |

FOREIGN PATENT DOCUMENTS

| | | | |
|---|---|---|---|
| 2824734 | 12/1979 | Fed. Rep. of Germany | 182/7 |
| 2580182 | 10/1986 | France | 182/7 |

*Primary Examiner*—Karen J. Chotkowski
*Attorney, Agent, or Firm*—Caesar, Rivise, Bernstein, Cohen & Pokotilow, Ltd.

[57] ABSTRACT

A safety system comprising a seat board assembly and an associated harness to be worn by a person located at an elevated position for releasable securement to a holding device to protect the person from falling. The harness is formed of interconnected webs of flexible, e.g., nylon, material. The seat board assembly includes a generally planar panel which is arranged to be releasably secured to the harness for supporting the person's buttocks thereon so that he or she may move about relatively unencumbered by the system. The system also includes a pair of extendable, flexible, repelling straps for connection to a lowering device mounting on an adjacent safety line to enable the person to repel down the line. The seat board panel has a pair of flexible connecting straps projecting from opposed sides thereof for releasable securment, e.g., via VELCRO fasteners, to respective buckles on the harness to suspend the seat board panel below the harness.

18 Claims, 5 Drawing Sheets

HARNESS AND SEAT BOARD REPELLING SYSTEM

BACKGROUND OF THE INVENTION

This invention relates generally to safety apparatus and more particularly to a harness and seat-board apparatus arranged to be worn by a person and which, depending upon how configured, performs various functions, namely, to prevent the person from falling from an elevated position, to suspend the person in a manner to enable the person to perform some activity while so suspended and without interference by the apparatus, and to enable the person to readily connect himself/herself to repelling means to repel to a lower elevation.

As a result of the enactment of various safety laws persons working at elevated height positions, e.g., window washers, telephone lineman, etc., are required to be protected against falls. One common approach to achieve that end is the use of a safety belt which is worn on the worker's waist. The belt is arranged to be worn about the waist of the workman and includes a D-ring or some other metal loop fixedly mounted on the belt in the center of the portion located at the worker's back. The D-ring is arranged to be "tied off" i.e., connected, via a lanyard or some other means, to a supporting member, e.g., a portion of a building or other static structure, a rope grab device mounted on a safety line, etc. Thus, once the worker is tied off should he/she fall off of the platform, scaffolding, or other support on which he/she is working or if that platform etc. itself drops or otherwise falls away, the worker will be prevented from falling to the ground.

While such safety belts are generally suitable for their intended purposes they are not designed to act as a primary means for suspending the person at an elevated position to enable him/her to perform some activity while so suspended. In fact such safety belts are generally incapable of such use since they tend to inhibit the person's mobility, thus interfering with the worker's ability to function efficiently when he/she is tied off.

Harnesses have been developed and sold to serve as a means to distribute the shock load across portions of the body of the wearer for fall protection purposes. Such harnesses typically include straps or loops which are arranged to encircle the wearer's thighs, a belt or some other portion to encircle the wearer's waist, and straps extending over the wearer's shoulders. Such harnesses typically also include at least one connection member, e.g., a D-ring, to enable the harness to be connected to some tie-off means for fall protection purposes.

So-called "bosun's chairs" or "seat-boards" have also been developed for applications wherein worker is to be suspended thereby and where some mobility is necessary. As is known a apparatus typically comprises board or other generally planar member configured to support the buttocks of a person and having straps or some other flexible members connected thereto for suspending the apparatus while the person is seated therein.

While such prior art "bosun's chair" or "seat-board apparatus" fulfill their intended suspension function without impairing the mobility of the wearer, they too provide less than optimum functionality.

Examples of lowering or repelling devices are found in U.S. Letters Pat. Nos. 3,220,511 and 3,250,515. Moreover, some such devices are commercially available. One particularly effective device for controlled lowering purposes is the SKY GENIE device sold by Descent Control, Inc. of Fort Smith, Ark.

The ability to be tied-off at an elevated position by being connected to a rope grab, or other suitable device, while enabling the ready disconnection therefrom and concomitant connection to a lowering or repelling device is of considerable importance from a safety standpoint and is the subject of my prior inventions. Those inventions are disclosed and/or claimed in my copending U.S. patent applications Ser. Nos. 07/466,898 and 07/533,610, filed on Jan. 18, 1990 and Jun. 5, 1990, and entitled Fall Prevention and Lowering System and Methods of Use, and Safety Harness, respectively, which are now abandoned.

OBJECTS OF THE INVENTION

Accordingly, it is a general object of this invention to provide a harness and associated seat board which overcomes the disadvantages of the prior art.

It is a further object of this invention to provide a safety system comprising a harness and seat-board assembly which are configurable for protecting a person located at an elevated position from falling, for suspending a person at an elevated position while enabling the person to perform some activity thereat without interference, and for enabling the person to repel down to a lower position when desired.

It is still a further object of this invention to provide in a safety system comprising a harness and a seat board assembly repelling means for ready connection to a lowering device.

It is yet a further object of this invention to provide a harness having means for readily connecting it to a seat board assembly and also having storable repelling straps for ready extension from a stowed position to an extended position at which they may be connected to a lowering device.

SUMMARY OF THE INVENTION

These and other objects of this invention are achieved by providing a safety system comprising a harness formed of a flexible material, e.g., nylon or polyester, to be worn by a person located at an elevated position for releasable securement to a holding device to protect the person from falling, and a seat board assembly. The seat board assembly is arranged to be releasably secured to the harness for supporting the person thereon so that the person may move about relatively unencumbered by the system.

The safety system also includes a pair of extendable members, e.g., flexible, repelling straps having conventional D-rings mounted thereon, for connection to a lowering device, e.g., a SKY GENIE device, mounted on an adjacent safety line to enable the person to repel down the line.

The seat board assembly comprises a support panel configured and arranged to support the buttocks of the person thereon and having a pair of connecting members, e.g., flexible, strap-like members, projecting from opposed sides of the panel. Each of the connecting members is arranged to be releasably secured to the harness, e.g., via respective buckles and associated VELCRO fasteners, to support the seat board assembly below the harness.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
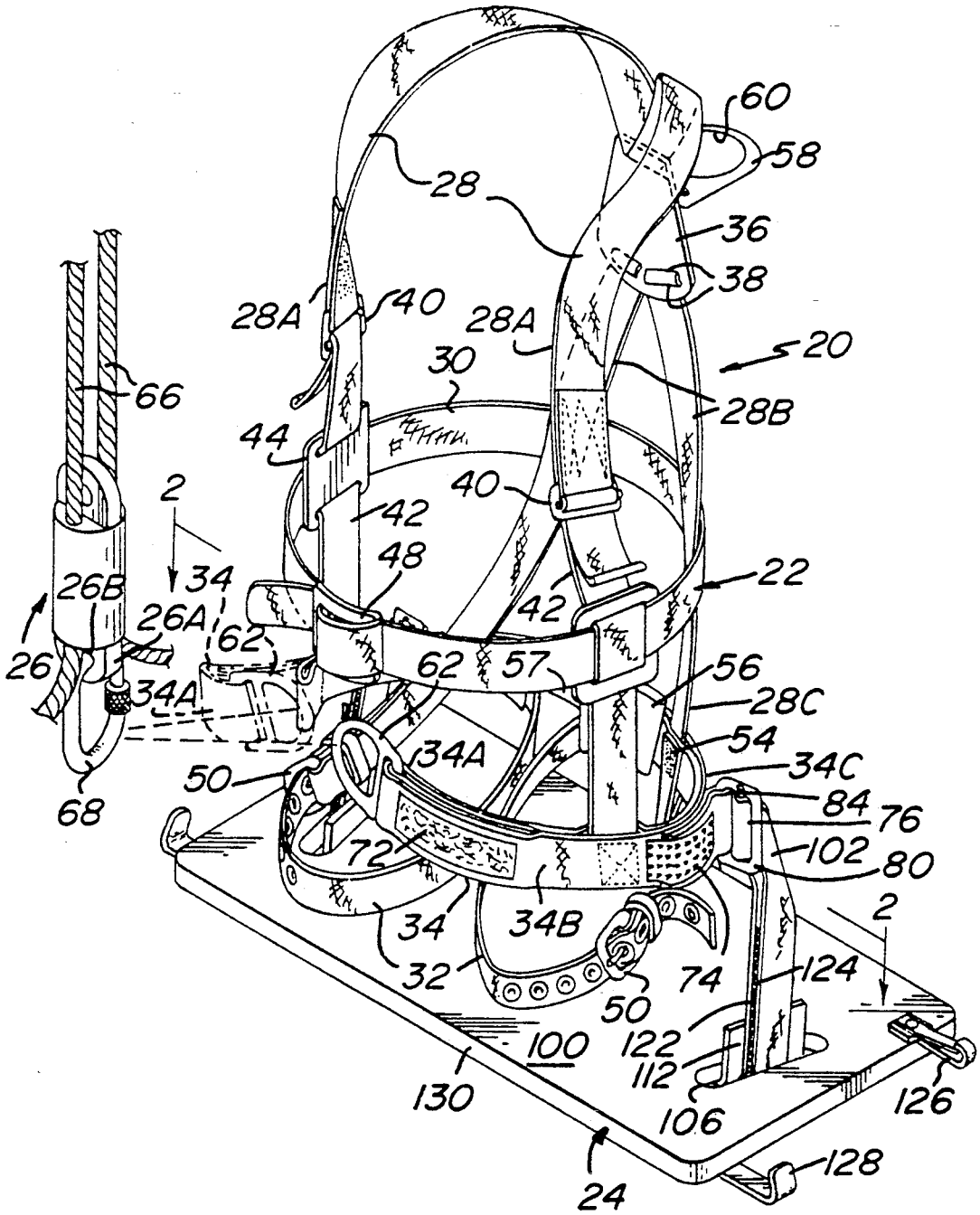
FIG. 1 is an orthogonal view of a harness and an associated seat board constructed in accordance with this invention and which are connected together to form a support system for a person located at an elevated position.

Referring now to various figures of the drawing where like reference numerals refer to like parts there is shown at 20 in FIG. 1 a safety system constructed in accordance with this invention. The system 20 basically comprises a harness assembly 22 and an associated seat board assembly 24. The two assemblies are arranged to be connected together to form the system 20.

The system is arranged to be worn by a person located at an elevated position to support/suspend him or her at that position in a comfortable manner so that he or she can perform some activity thereat substantially unencumbered or unhindered by the system. Moreover, the means for suspending or supporting the system can be used to connect the system 20 to any type of lowering device, e.g., the heretofore mentioned SKY GENIE device 26, to enable the person to repel himself or herself to a lower position. Further still the system includes means for connecting it to some tie off device, e.g., a rope grab, (not shown) or some fixed structure (not shown) for fall prevention purposes.

Figure 5:
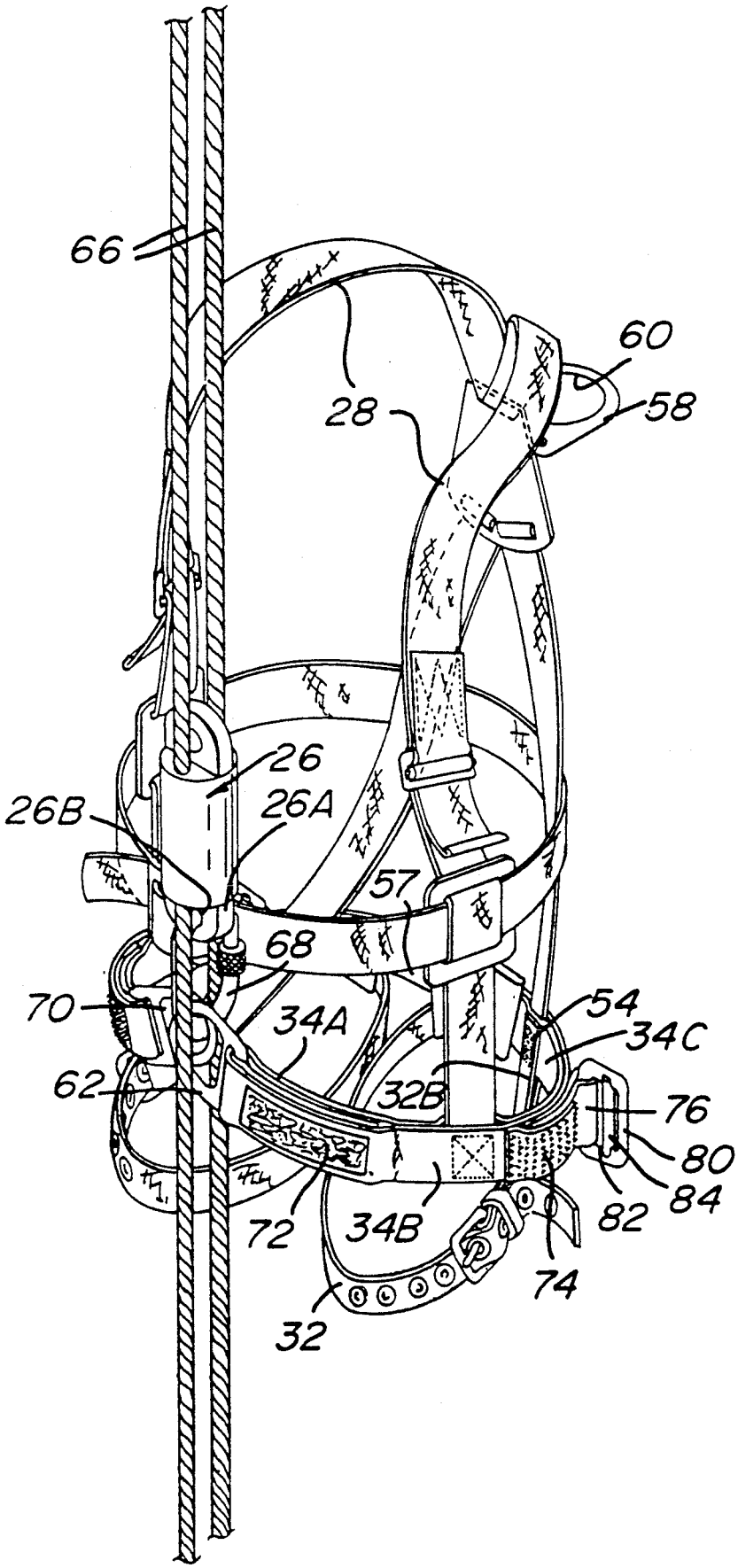
FIG. 5 is a view similar to that of FIG. 4 but showing the harness with its support/repelling straps extended and connected to a conventional lowering device.

As shown in FIG. 5 the harness assembly 22 itself is arranged to be worn by the person to support/suspend him or her at an elevated position so that he or she can perform some activity thereat, also substantially unencumbered or unhindered by the harness assembly, or to connect to it any lowering device for repelling purposes. So too, the harness assembly includes means for connection to a tie off device for fall prevention purposes.

Figure 4:
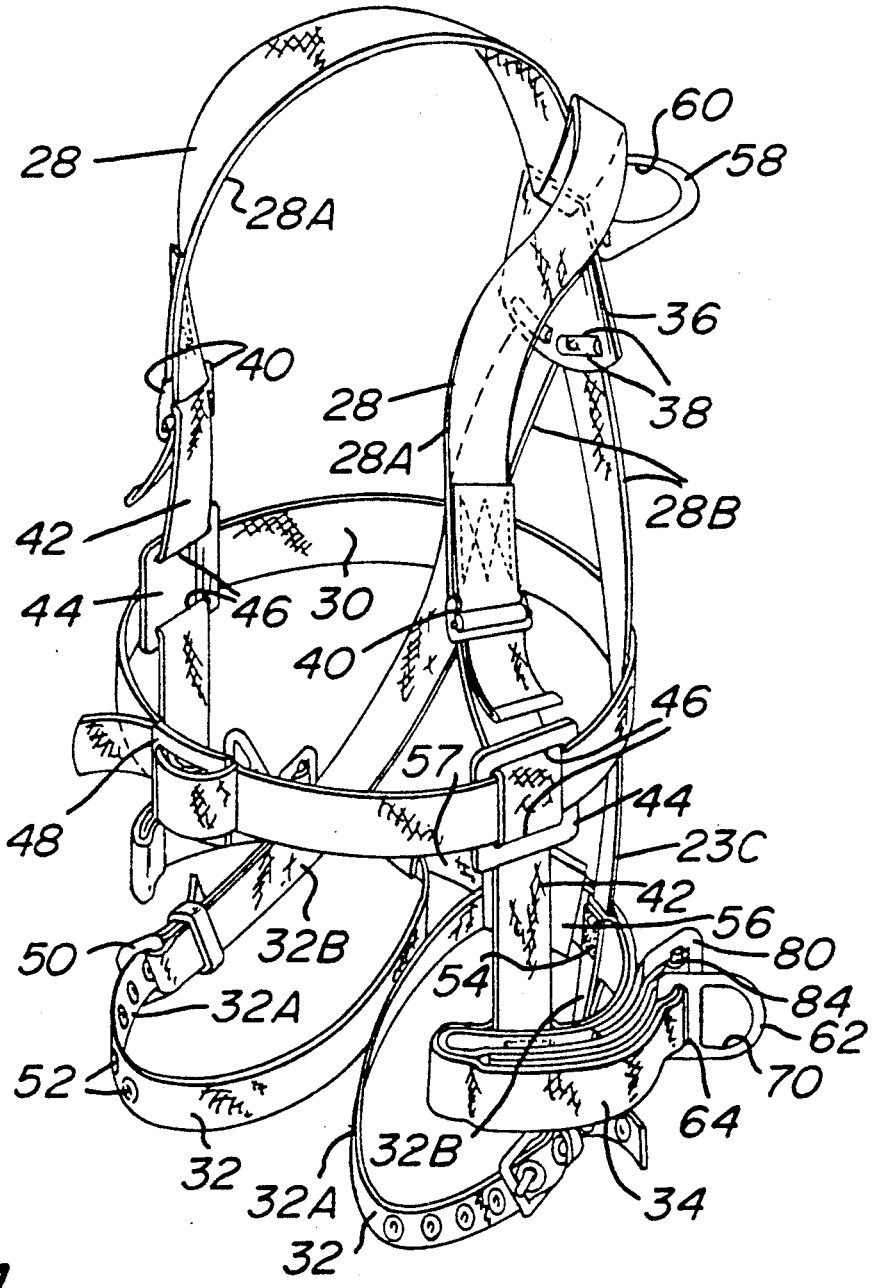
FIG. 4 is an orthogonal view of the harness shown in FIG. 1 with its support/repelling straps disposed in a retracted or stowed orientation.

Referring now to FIGS. 1, 4 and 5 it can be seen that the harness assembly 22 comprises a plurality of flexible straps, formed of a high-strength woven plastic or other type material, e.g., nylon or polyester, which are fixedly secured together, e.g., stitched, to form a configuration into which the upper torso and legs of a person (not shown) are to be located when the harness is worn by the person.

The harness basically comprises a pair of chest/shoulder/back straps 28, a waist belt strap 30, a pair of leg straps 32 and a pair of support/repelling straps 34. Each of the straps 28 includes a front portion, designated by the reference number 28A, which is arranged to extend vertically on a respective side of the wearer's chest and over the wearer's shoulder for connection at a joint member 36 located at approximately the middle of the wearer's back. The joint member basically comprises a panel formed of any suitable strong material, such as leather or plastic, and having slots 38 therein through which the straps 28 extend and criss-cross to form respective back portions 28B. Each strap portion 28B crosses the waist belt 30 and is preferably fixedly secured, e.g., sewn, thereto. The lower rear end of each of the straps 28 is denoted by the reference numeral 28C and is fixedly secured, e.g., sewn, to a respective one of the leg straps 32 and a respective one of the support/repelling straps 34.

The lower end of each of the chest strap portions 28A includes a buckle 40 mounted thereon. In particular, the free end of portion 28A extends through the buckle, is folded back over itself, and is sewn together to hold the buckle in place. The buckle 40 serves as a means for connecting the chest strap portion 28A to an associated, downwardly extending intermediate strap 42. The upper end of each intermediate strap 42 extends through the buckle 40 of an associated chest strap 28A to releasably secure the chest strap portion 28A to the intermediate strap 42 and to enable the adjustment of those straps to comfortably accommodate the individual wearing the harness assembly 22.

Each intermediate strap 42 extends through an associated joint member 44. Each joint member 44 comprises a panel formed of a suitable material, e.g., leather or plastic, and having slots through which the associated intermediate strap 42 extends to hold the joint member on the intermediate section. The waist belt or band 30 extends through the interface between the intermediate strap 42 and the joint member 44 to adjustibly secure each of those intermediate straps to the waist band on each side of the wearer's body, i.e., over the wearer's hips. The lower end of each of the intermediate straps is fixedly secured, such as by stitching, to portions of the support/repelling straps 34, as will be described later.

In order to adjust the size of the waist strap, a conventional buckle 48 is mounted thereon at the front of the waist strap.

The leg straps 32 each comprise a pair of strap portions 32A and 32B. Strap portion 32B includes a free end having a buckle 50 mounted thereon, while portion 32A includes a free end having a plurality of conventional eyelets 52 located therein. One end of each of the strap portions 32B is connected to one end of its associated strap portion 32A and to the lower end of back strap portion 28C at a sewn joint 54 (FIGS. 4 and 5). Accordingly, the strap portions 32A and 32B of each of the leg straps 32 form an adjustibly sized loop through which one of the person's legs can extend. A respective pad 56 is mounted on each of the strap portions 32A adjacent its joint 54 to engage the back of the wearer's thigh to thereby dissipate pressure applied thereto when the person is wearing the harness assembly and is supported thereby. A subpelvic strap 57, formed of the same material as the other straps of the harness assembly, is connected between the rear portions of the leg straps portions 32A. This strap provides additional support below the buttocks for the wearer to absorb shock when the harness serves as a fall prevention device.

As should be appreciated by those skilled in the art by the adjustment of the various buckles 40, 48 and 50, the harness assembly 22 can be configured to readily conform to the body of the wearer.

In the configuration shown in FIG. 4, the harness assembly 22 is adapted to be connected to some tie-off means (not shown) to serve as a fall preventing device. In order to connect the harness assembly 22 to the tie-off means the harness assembly 22 includes a conventional D-ring 58 which is fixedly secured onto the back surface of the joint member 36. The D-ring 58 includes a central opening or hole 60 to which a clip (not shown) on a lanyard (not shown) may be releasably secured to connect the D-ring to the lanyard and to a tie-off device, e.g., rope grab (not shown), as is conventional.

When the harness assembly is in the configuration shown in FIG. 4 its support/repelling straps 34 are in a folded or stowed position, as will be described in detail hereinafter. In such a position they are retracted so that they do not flap about and possibly interfere with the activities of the wearer of the harness.

When it is desired to suspend the worker by the harness assembly 22 from some means, such as the lowering device 26, the support/repelling straps 34 are moved to the extended position shown in FIG. 5 for connection to the lowering device 26.

The details of the support/repelling straps 34 will now be described and can be best understood by reference to FIGS. 2, 3, 4 and 5. As can be seen therein, the straps 34 each include a front or free end portion 34A, an intermediate portion 34B and a rear end portion 34C. The portions 34A, 34B and 34C are formed as an integral unit of a double thickness web of the same material as the other straps of the harness assembly. Each free end portion 34A is folded over itself and sewn in place to mount thereon a conventional D-ring 62. To that end the portion 34A of the repelling strap 34 extends through a slot 64 (FIG. 2) in the D-ring and is folded back over itself and fixedly secured, e.g., sewn, to hold the D-ring in place on the free end of strap portion 34A. The intermediate portion 34B of the support/repelling strap 34 is fixedly secured, e.g., sewn, to the lower end of the associated intermediate strap 42. The rear end 34C of the support/repelling strap 34 is fixedly secured to the portions 28C, 32A and 32B of the associated straps at joint 54.

When connected as just described each of the strap portions 34A is arranged to be folded back over itself in the location of portion 34B to hold it in its retracted or stowed state like that shown in FIG. 4.

When it is desired to connect the harness assembly 22 to the lowering means 26 (or to some other support structure for supporting the worker) by the harness, the strap portions 34A are extended to the position shown in FIG. 5. The D-rings 62 at the end of the two straps 34 ar then oriented for connection to the support or lowering device. For example, as shown in FIG. 5, the two straps 34 are extended so that each of their D-rings 62 is connected to the lowering device 26, which, as is conventional, is mounted on a extending safety line 66. The lowering device 26 includes a downwardly projecting tab portion 26A having an opening 26B therein through which a conventional connector or carabiner 68 passes. The carabiner 68 is arranged to also pass through the central opening 70 in each of the D-rings 62.

In order to prevent the lowering device from sliding down the line 66 it is "locked out", as is conventional. Thus, with the person wearing the harness assembly being connected by that assembly to a locked out device 26 the worker will be suspended thereby. To descend or repel to a lower elevation the worker unlocks the lowering device so that it is no longer locked out, whereupon the person commences a controlled descent down the line 66.

In order to hold the free end portions 34A of the repelling straps in the retracted position like that shown in FIG. 4, releasable securement means are provided. Such means preferable comprise a pair of VELCRO fasteners. Thus, as can be seen clearly in FIGS. 1, 3 and 5 each support/repelling strap portion 34A includes a patch 72 of one component, e.g., the multiloop component, of a VELCRO fastening system fixedly secured, e.g., sewn, on its outer surface adjacent its D-ring 62. A patch 74 of the other and cooperating component, e.g., the multihook component of the VELCRO fastening system, is fixedly secured, e.g., sewn, onto a connecting strap 76. The connecting strap 76 comprises a portion of the harness assembly and serves as a means of connecting the seat board assembly 24 to the harness assembly 22. Each connecting strap 76 is formed of the same material as the other straps of the harness and is fixedly secured, e.g., sewn, to an associated support/repelling strap 34 adjacent the junction of the intermediate strap 42 and the support/repelling strap portion 34B.

As should thus be evident each support/repelling strap portion 34A can be folded over its portion 34B and held tightly thereagainst by the engagement of the VELCRO patches 72 and 74 when the harness assembly 22 is not to be used for either support or repelling purposes or when the system 20 is not to be used for repelling purposes. However, when it is desired to connect the harness assembly 22 to the lowering device 26, the two support/repelling strap portions 34A can be peeled away from the remaining portions thereof to the extended position shown in FIG. 5. Similarly, when it is desired to connect the system 20 to some support device (not shown) to suspend the system therefrom or to connect it to a lowering device 26 for repelling purposes, the two support/repelling strap portions can be extended to the position shown in FIG. 1.

It should be pointed out at this juncture that the use of a D-ring 62 at the free end of each support/repelling straps 34 for connection to the lowering device 26 or to some other support means is merely exemplary. Thus, the D-rings may be replaced by loops (not shown) at each free end of the strap portions 34A. In such a case the loops are formed by folding over the free end of each of the straps and stitching them in the same manner as the rest of the harness.

Although not shown in the drawing herein the harness assembly 22 preferably includes a holster or pouch which is mounted on the waist belt 30 adjacent one of the wearer's hips to be readily accessible. The holster may be releasably secured, e.g., held by VELCRO fasteners or slidingly mounted on a strap of the harness assembly, or may be fixedly secured, e.g., sewn, on the harness assembly, as desired. The holster is of the type shown in my aforenoted U.S. patent application Ser. No. 07/533,610. Thus, the holster includes plural walls made up of any suitable material, e.g., leather, nylon, rubberized fabric, plastic, to form a hollow interior space or cavity which is arranged to store desired components, e.g., the lowering device 26, the carabiner 68, etc., or tools, e.g., a knife, screw driver, etc., therein.

In order to ensure that the items disposed within the holster do not fall out, the holster preferrably includes a moveable flap disposed over its hollow interior to close the interior. The flap is arranged to be held in place closing the holster via releasable fastening means, e.g., VELCRO fasteners.

Figure 2:
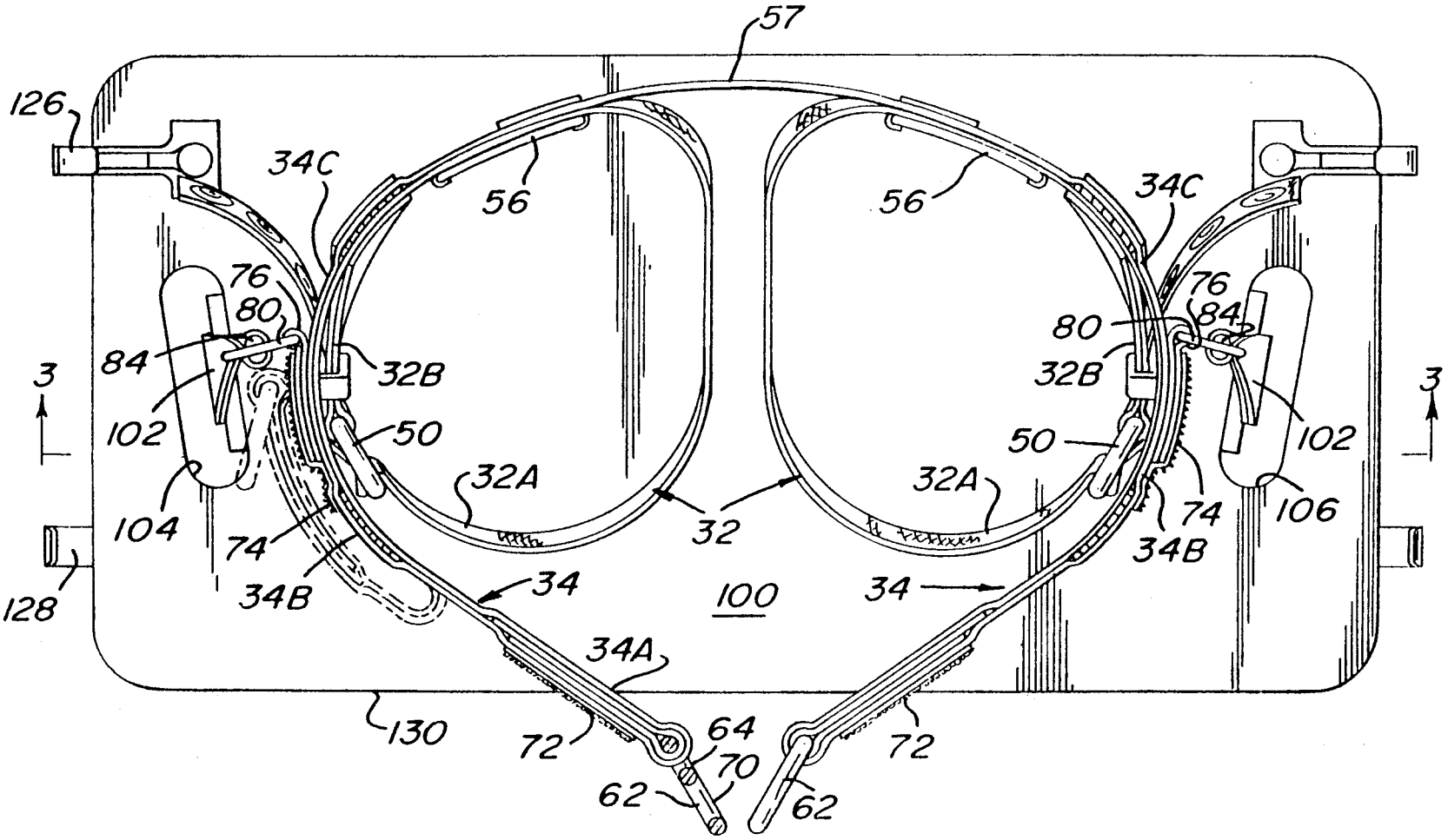
FIG. 2 is an enlarged, top plan view of the support system shown in FIG. 1.
Figure 3:
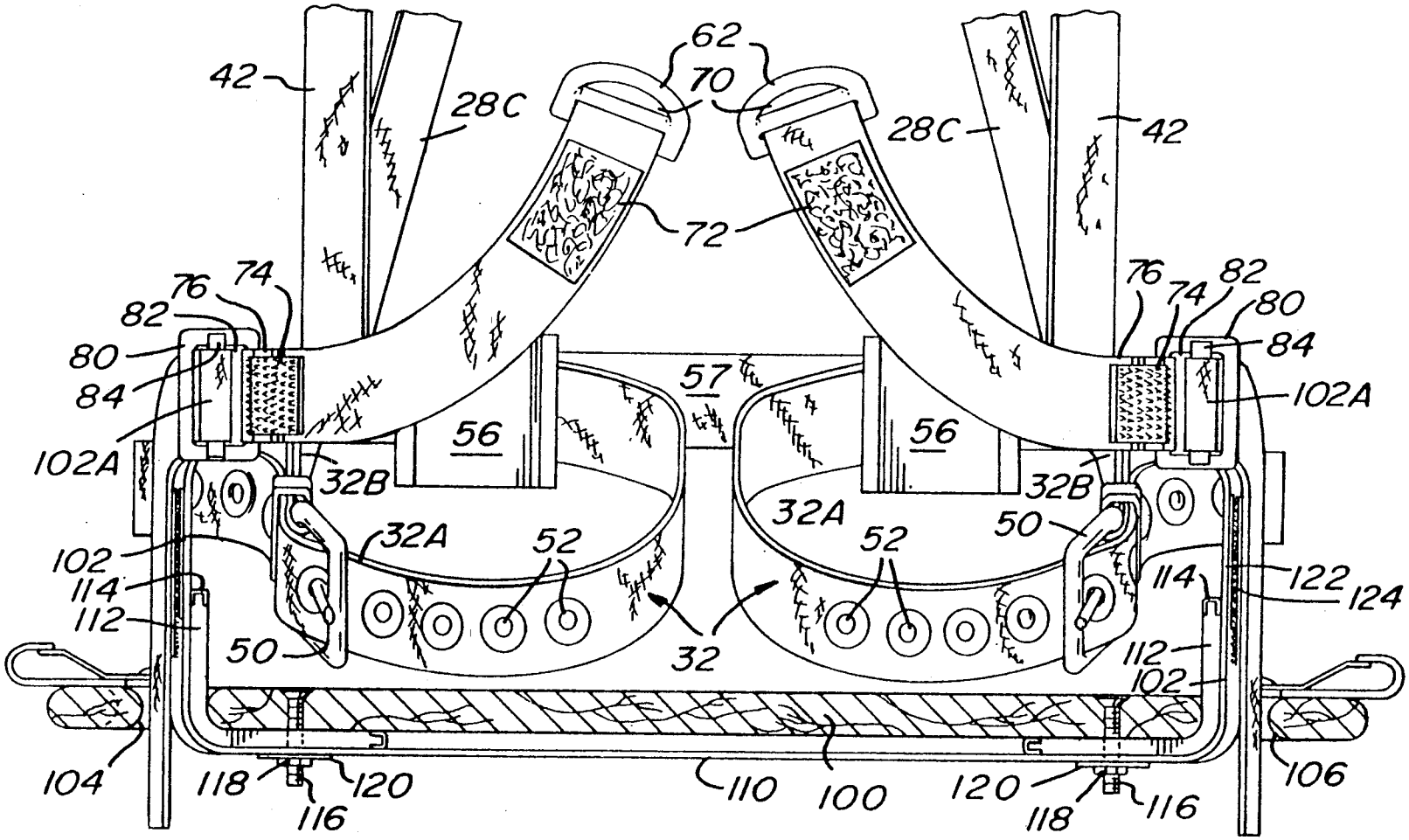
FIG. 3 is a sectional view taken along line 3—3 of FIG. 2.

Referring to FIGS. 1-3 the details of the seat board assembly 24 will now be considered. Thus, as can be seen therein the seat board assembly 24 basically comprises an assembly of a planar, rectangular panel 100 formed of any suitable material, e.g., wood, plastic, etc.

and a pair of connecting straps 102. The panel member 100 includes a pair of slots 104 and 106 extending therethrough closely adjacent each side 108 thereof. The straps 102 actually comprises a single web 110 of flexible woven material like that making up the harness assembly, and is fixedly secured at its middle portions to the underside of the panel 100. Each free end portion of the web 100 extends through an associated slot 104 or 106 to form a respective connecting strap 102.

In order to reinforce the portions of the connecting straps 102 where they pass through the slots 104 and 106, respectively, a pair of pads 112 formed of a material like that forming the harness pads 56 are interposed between the under surface of the panel 100 and the inside surface of the web 110 as shown in FIG. 3. A portion of each of the pads 112 extends through its respective slot 104 and 106. In order to prevent the pads from raveling, each end of each pad 112 includes a rubberized fabric cap 114 sewn thereon.

The web 110 forming the connecting straps 102 is fixedly secured to the seatboard panel 100 by pairs of threaded fasteners or screws 116 and associated nuts 118 and washers 120 as shown in FIG. 3.

As can be seen clearly in FIGS. 1, 2, 3, and 5 each of the connecting straps includes a buckle 80 fixedly secured on the free end thereof. In particular the free end of each connecting strap 76 is folded over itself, extended through a slot 82 in the buckle 80, and sewn to itself. Each buckle 80 includes a chape 84 about which the free end 102A of an associated connecting strap 102 of the seat board assembly extends to secure the seat board assembly to the harness assembly. To accomplish that end the outer surface the free end portion 102A of each connecting strap 102 includes a patch 122 of one component, e.g., the multiloop component, of a VELCRO fastening system sewn thereon. A patch 124 of the other component of the VELCRO fastening system is fixedly secured, e.g., sewn, onto the outer surface of the strap portion 102A but spaced from the patch 122. Accordingly, each strap portion 102A can be extended through slot 82 in buckle 80 about its chape 84 and folded over itself so that it's patches 122 and 124 releasably engage each other and hold the strap in the buckle as shown clearly in FIG. 1.

A pair of conventional spring clips 126 are mounted on the top surface of the seatboard 100 adjacent each side thereof. These clips serve to support work materials, e.g., a bucket or some other item. A pair of hook members 128 are also mounted on the seat board 100 projecting outward from its underside on each side thereof and adjacent its front edge 130. The hook-like members 128 each include an opening (not shown) therein for providing additional support for work materials.

As should be appreciated by those skilled in the art, when the system 20 is worn by the person, i.e., the person is wearing the harness with the seatboard assembly secured thereto, the panel 100 forms a seat for the person's buttocks. Thus, the person may comfortably sit on the seat and be supported by any device from which the system 20 is suspended. The person is then free to work from that suspended position unencumbered by the system.

Without further elaboration the foregoing will so fully illustrate my invention that others may, by applying current or future knowledge, adopt the same for use under various conditions of service.

I claim:

1. A safety system comprising:

(a) a body engaging member, said body engaging member including a belt formed of a flexible material to be worn by a person located at an elevated position for releasable securement to a holding device to protect the person from falling;

(b) a seat board assembly, said seat board assembly comprising a support panel configured and arranged to support the buttocks of the person thereon and having a pair of connecting members projecting from opposed sides of said support panel, said seat board assembly being arranged to be releasably secured to said body engaging member for supporting the person thereon so that said person may move about relatively unencumbered by said system; and (c) at least one extendable member comprising a first end secured to the body engaging member and a second free end movable from a retracted inoperative position to an extended operative position, said second free end including connecting means for connecting said at least one extendable member to a lowering device when said second free end is in said extended position, retaining means for releasably maintaining said at least one extendable member in the retracted inoperative position wherein said connecting means is not accessible for connection to a lowering device, said lowering device being mounted on an adjacent line to enable the person to repel down said line, and wherein said at least one extendable member is independent of said pair of said connecting members.

2. The safety system of claim 1 wherein each of said at least one extendable member is a flexible, strap-like member.

3. The safety system of claim 1 wherein each of said pair of connecting members is a flexible, strap-like member.

4. The safety system of claim 2 wherein each of said pair of connecting members is a flexible, strap-like member.

5. The safety system of claim 2 wherein said retaining means includes means on the flexible strap-like member for releasable securing said member in said retracted position, until it is desired to extend said flexible strap-like member, whereupon said flexible strap-like member may be extended outwardly from said body engaging member to connect said second end to said lowering device through said connecting means.

6. The safety system of claim 5 wherein said releasably securable means comprises cooperating hook and loop fastening means.

7. The safety system of claim 3 wherein said support panel comprises a generally planar board having an opposed pair of sides and wherein each of said strap-like members of said connecting members is secured to the underside of said board and extends upward from said board adjacent a respective side thereof.

8. The safety system of claim 7 wherein said board includes a pair of openings, each of said openings being located adjacent a respective side of said board and wherein said strap-like, members of said connecting members extend through respective ones of said openings.

9. The safety system claim 5 wherein each of said connecting members is a flexible, strap-like member, wherein said support panel comprises a generally planar board having an opposed sides and wherein each of said pair of flexible, strap-like members is secured to the underside of said board and extends upward from said board adjacent a respective side thereof.

10. The safety system of claim 9 including a pair of extendable members, wherein said body engaging member includes respective means for buckling located adjacent each of said pair of extendable members, and wherein each of said flexible, strap-like members of said connecting members including a free end portion adapted to be releasably secured to a respective one of said means for buckling.

11. The safety system of claim 10 wherein each of said free end portions of said flexible, strap-like members of said connecting members is arranged to pass through a respective one of said means for buckling and includes means for releasably securing each of said flexible, strap-like members of said connecting members about said means for buckling.

12. The safety system of claim 11 wherein said releasably securable means comprises cooperating hook and loop fastening means.

13. The system of claim 1 including a pair of said extendable members, wherein said body engaging member includes attachment members located adjacent each of said pair of extendable members, and wherein each of said connecting members of said seat board assembly includes an attachment portion adapted to be removably secured to an associated attachment member.

14. The system of claim 13 wherein said attachment members include buckles located adjacent each of said pair of extendable members, and wherein said attachment portion of each of said connecting members includes a free end portion adapted to be secured to an associated buckle.

15. The safety system of claim 14 wherein said free end portion of each of said connecting members is arranged to pass through said associated buckle and includes means for releasably holding it therein.

16. The safety system of claim 15 wherein said releasably securable means comprises cooperating hook and loop fastening means.

17. A safety system comprising:

(a) a body engaging member, said body engaging member including a belt formed of a flexible material to be worn by a person located at an elevated position and including connector means for releasable securement to a holding device to protect the person from falling;

(b) a seat board assembly, said seat board assembly comprising a support panel configured and arranged to support the buttocks of the person thereon and having a pair of connecting members projecting from opposed sides of said support panel, said seat board assembly being arranged to be releasably secured to said body engaging member for supporting the person thereon so that said person may move about relative unencumbered by said system; and (c) at least one extendable member comprising a first end secured to the body engaging member and a second end movable from a retracted position to an extended position, said second end including connecting means for connecting said at least one extendable member to a lowering device when said second end is in said extended position, said lowering device being mounted on an adjacent line to enable the person to repel down said line, and wherein said at least one extendable member is independent of said pair of said connecting members.

18. The safety system of claim 17 wherein said second end is a free end movable from a retracted inoperative position to an extended operative position, and further including retaining means for releasably maintaining said at least one extendable member in the retracted inoperative position wherein said connecting means is not accessible for connection to a lowering device.

* * * * *